US005820487A

United States Patent [19]

Nakamura et al.

[11] Patent Number: 5,820,487

[45] Date of Patent: Oct. 13, 1998

[54] THREE-PIECE SOLID GOLF BALL

[75] Inventors: Atsushi Nakamura; Hisashi Yamagishi, both of Chichibu, Japan

[73] Assignee: Bridgestone Sports Co., Ltd., Tokyo, Japan

[21] Appl. No.: 821,639

[22] Filed: Mar. 20, 1997

[30] Foreign Application Priority Data

Mar. 29, 1996 [JP] Japan ..... 8-104308

[51] Int. Cl.[6] ..... A63B 37/06; A63B 37/12

[52] U.S. Cl. ..... 473/374; 473/373

[58] Field of Search ..... 473/373, 374, 473/378, 384; 273/DIG. 20

[56] References Cited

U.S. PATENT DOCUMENTS

| | | | |
|---|---|---|---|
| 4,431,193 | 2/1984 | Nesbitt | 473/374 |
| 5,048,838 | 9/1991 | Chikaraishi | 473/373 X |
| 5,273,286 | 12/1993 | Sun | 473/376 X |
| 5,439,227 | 8/1995 | Egashira et al. | 473/377 X |
| 5,601,503 | 2/1997 | Yamagishi et al. | 473/351 X |
| 5,688,191 | 11/1997 | Cavallaro et al. | 473/373 |

*Primary Examiner*—George J. Marlo

*Attorney, Agent, or Firm*—Sughrue, Mion, Zinn, Macpeak & Seas, PLLC

[57] ABSTRACT

A three-piece solid golf ball of the three-layer structure comprising a solid core, an intermediate layer, and a cover is provided. When hardness is expressed by JIS-C scale hardness, the core surface hardness is higher than the core center hardness by 8–20 degrees, the intermediate layer hardness is higher than the core surface hardness, and the cover hardness is higher than the intermediate layer hardness. The ball has a weight of 41–44.5 grams. The golf ball exhibits consistent performance independent of head speeds.

5 Claims, 1 Drawing Sheet

THREE-PIECE SOLID GOLF BALL

BACKGROUND OF THE INVENTION

1. Field of the Invention

This invention relates to a three-piece solid golf ball of the three-layer structure comprising a solid core, an intermediate layer and a cover, and more particularly, to such a three-piece solid golf ball wherein the hardness distribution of the core and the overall hardness distribution of the ball are optimized such that many players may favorably use the ball regardless of their head speed.

2. Prior Art

From the past, golf balls of various structures are on the market. Among others, two-piece solid golf balls having a rubber base core enclosed with a cover of ionomer resin or the like and thread-wound golf balls comprising a wound core having thread rubber wound around a solid or liquid center and a cover enclosing the core share the majority of the market.

Most amateur golfers are fond of two-piece solid golf balls which have excellent flying performance and durability although these balls have the disadvantages of a very hard feel on hitting and low control due to quick separation from the club head on hitting. For this reason, many professional golfers and skilled amateur golfers prefer wound golf balls to two-piece solid golf balls. The wound golf balls are superior in feeling and control, but inferior in flight distance and durability to the two-piece solid golf balls.

Under the present situation that two-piece solid golf balls and wound golf balls have contradictory characteristics as mentioned above, players make a choice of golf balls depending on their own skill and taste.

In order to develop solid golf balls having a feel approximate to the wound golf balls, various two-piece solid golf balls of the soft type have been proposed. To obtain such two-piece solid golf balls of the soft type, soft cores are used. Softening the core can reduce resilience, deteriorate flight performance, and substantially lower durability, resulting in two-piece solid golf balls which not only fail to possess their characteristic excellent flight performance and durability, but also lose actual playability.

One attempt to solve the above-mentioned problems is to interpose an intermediate layer between the solid core and the cover. Various solid golf balls of such three-layer structure have been proposed. These three-piece solid golf balls can effectively overcome the defects of conventional two-piece solid golf balls. That is, hitting feel and controllability can be improved while excellent flight performance and durability are maintained.

However, most of the three-piece solid golf balls target those golfers with a high head speed of 45 m/sec. or higher, that is, experienced players. Then those golf players capable of high head speed swing can take advantage of the balls, enjoying an increased flying distance and pleasant feeling. However, those golf players who are slow in head speed, including beginner, female and senior players cannot take full advantage of the balls. The reason is that the flight performance is more dependent on a head speed since a weaker force applied to the ball upon impact causes a smaller deformation to the ball. Thus low head speed players cannot get an increased flight distance and pleasant feel. Besides, as the number of golf players is increased, players' requirements on ball characteristics (flight performance, feeling, controllability and durability) are diversified. It is thus desired to have a golf ball which can match with an individual player's ability and taste and especially has little dependency on head speed.

SUMMARY OF THE INVENTION

An object of the present invention is to provide a golf ball which can offer an increased flight distance and pleasant feel over a wide range of head speed from low to high head speeds and be favorably used by many players regardless of their head speed.

Making extensive investigations on a three-piece solid golf ball of the three-layer structure comprising a solid core, an intermediate layer, and a cover for achieving the above object, we have found that by optimizing the hardness distribution of the core such that the core surface hardness is higher than the core center hardness, making the intermediate layer hardness higher than the core surface hardness, making the cover hardness higher than the intermediate layer hardness, and reducing the ball weight, there is obtained a ball structure that provides a high trajectory and high restitution upon low head speed shots. In particular, upon full shots with a driver by a low head speed player, flight performance and feeling are dramatically improved. There is obtained a solid golf ball having little head speed dependency.

More specifically, the invention provides a three-piece solid golf ball of the three-layer structure comprising a solid core, an intermediate layer, and a cover, wherein the solid core at its surface and center, intermediate layer, and cover each have a hardness as measured by a JIS-C scale hardness meter, the core surface hardness is higher than the core center hardness by at least 8 degrees, the intermediate layer hardness is higher than the core surface hardness, and the cover hardness is higher than the intermediate layer hardness, and the ball has a weight of 41 to 44.5 grams. The following advantages are obtained from these restrictions. (1) First, a core having an optimum hardness distribution is formed. With respect to ball deformation upon impact, the core surface formed harder than the core center is effective for preventing excessive deformation and efficiently converting distortion energy into reaction energy, resulting in an increased flying distance. Even on low head speed shots, the soft core center provides sufficient restitution and soft pleasant hitting feel. Additionally, since the core is sequentially enclosed with a harder intermediate layer and a further harder cover, the ball as a whole has an optimum hardness distribution. The resulting golf ball minimizes the energy loss caused by excessive deformation upon impact and has efficient restitution. (2) Secondly, a reduced ball weight allows lift to work effectively so that the ball tends to rise high to follow a high trajectory even upon impact at a low head speed. (3) The cover hardness made higher than the intermediate layer hardness and core surface hardness allows the ball to gain an optimum spin rate upon full shots with a driver at a speed in medium to high head speed ranges, preventing the lightweight ball from yielding a sharp rise and short carry.

We have found that owing to the above advantages (1) to (3) accomplished by controlling the hardness distribution of a lightweight three-piece solid golf ball as defined above, there is obtained a golf ball which has very little head speed dependency in that outstanding improvements in flying distance and feeling are achieved upon full shots with a driver or the like by a low head speed player. Despite such improvements, the performance upon impact at a medium or high head speed is not degraded. The present invention is predicated on this finding.

BRIEF DESCRIPTION OF THE DRAWINGS

The only figure.

DETAILED DESCRIPTION OF THE INVENTION

Figure 1:
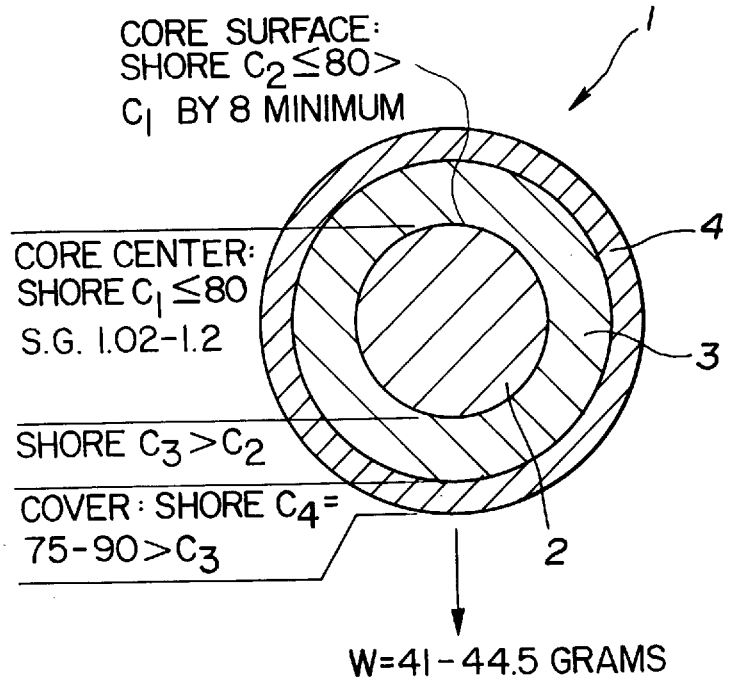
FIG. 1 is a schematic cross-sectional view of a three-piece solid golf ball according to one embodiment of the invention.

Referring to FIG. 1, a lightweight three-piece solid golf ball 1 according to the invention is illustrated as comprising a solid core 2 having an optimized hardness distribution, an intermediate layer 3 harder than the surface of the core 2, and a cover 4 harder than the intermediate layer 3.

The three-piece solid golf ball 1 according to the present invention has a weight of 41 to 44.5 grams, preferably 42 to 44 grams, more preferably 43 to 44 grams. A ball of less than 41 grams provides good hitting feel, but has problems that it is susceptible to the wind during flight, it tends to loft due to the lift created by a back spin, and it fails to travel a sufficient flight distance because of too small inertia force. A ball of more than 44.5 grams is not different from conventional three-piece solid golf balls, so that high trajectory assisted by lift and good performance upon low head speed shots are lost.

In addition to the above-mentioned ball weight requirement, the solid golf ball 1 of the present invention requires to optimize the hardness distribution of the solid core 2. The hardness referred to herein is a hardness as measured by a JIS-C scale hardness meter unless otherwise stated. More particularly, the core surface hardness is made to be higher than the core center hardness by at least 8 degrees, preferably 8 to 20 degrees, more preferably 9 to 17 degrees. With a hardness difference of less than 8 degrees, both pleasant feeling and high restitution may not be satisfied. The hardness distribution establishing such a hardness difference between the surface and the center of the core ensures that the core surface formed harder than the core center is effective for preventing excessive deformation of the core and efficiently converting distortion energy into reaction energy when the ball is deformed upon impact. Additionally, the core center softer than the core surface can improve feeling and provide for sufficient deformation and satisfactory restitution even in a low head speed range.

The hardness distribution of the solid core 2 is not particularly limited insofar as the core is formed such that the core surface is harder than the core center by at least 8 degrees. It is preferable from the standpoint of efficient energy transfer that the core is formed such that the core becomes gradually softer from its surface toward its center.

Although the surface hardness and the center hardness of the core 2 are not particularly limited insofar as the difference between them is within the above-mentioned range, it is preferred that the core surface hardness be up to 80 degrees, preferably 60 to 80 degrees on JIS-C hardness scale. A core with a surface hardness of more than 80 degrees would be too hard and deteriorate feeling. On the other hand, a core with a surface hardness below 60 degrees would be too soft so that the ball might lose both restitution and durability. Preferably the core center hardness is 40 to 80 degrees, especially 45 to 75 degrees on JIS-C hardness scale.

The solid core preferably has a specific gravity of 1.02 to 1.2, especially 1.02 to 1.15 though not critical. No particular limit is imposed on the diameter, overall hardness, weight and other parameters of the solid core and they are suitably adjusted insofar as the objects of the invention are attainable. Usually, the solid core has a diameter of 37 to 41 mm, especially 38 to 40 mm, an overall hardness corresponding to a distortion of 2.5 to 5 mm, especially 2.8 to 5 mm under a load of 100 kg applied, and a weight of 27 to 40 grams, especially 30 to 37 grams.

In the practice of the invention, no particular limit is imposed on the composition from which the solid core is formed, and the solid core can be formed using a base rubber, a crosslinking agent, a co-crosslinking agent, and an inert filler and the like as used in the formation of conventional solid cores. The base rubber used herein may be natural rubber and/or synthetic rubber conventionally used in solid golf balls although 1,4-cis-polybutadiene having at least 40% of cis-structure is especially preferred in the invention. The polybutadiene may be blended with a suitable amount of natural rubber, polyisoprene rubber, styrene-butadiene rubber or the like if desired. The crosslinking agent includes organic peroxides such as dicumyl peroxide, di-t-butyl peroxide, and 1,1-bis(t-butylperoxy)-3,3,5-trimethylcyclohexane, with a blend of dicumyl peroxide and 1,1-bis(t-butylperoxy)-3,3,5-trimethylcyclohexane being preferred. In order to form a solid core so as to have the above-defined hardness distribution, it is preferable to use a blend of dicumyl peroxide and 1,1-bis(t-butylperoxy)-3,3,5-trimethylcyclohexane as the crosslinking agent and the step of vulcanizing at 160° C. for 20 minutes. Also the difference in hardness between the core center and the core surface can be changed by suitably changing the vulcanizing temperature and time. No particular limit is imposed on the co-crosslinking agent, and examples include metal salts of unsaturated fatty acids, inter alia, zinc and magnesium salts of unsaturated fatty acids having 3 to 8 carbon atoms (e.g., acrylic acid and methacrylic acid), with zinc acrylate being especially preferred. It is noted that the amount of the crosslinking agent blended is suitably determined although it is usually about 0.5 to 3 parts by weight per 100 parts by weight of the base rubber. Examples of the inert filler include zinc oxide, barium sulfate, silica, calcium carbonate, and zinc carbonate, with zinc oxide and barium sulfate being often used. The amount of the filler blended is usually up to 40 parts by weight per 100 parts by weight of the base rubber although the amount varies with the specific gravity of the core and cover, the standard weight of the ball, and the like and is not particularly limited. In the practice of the invention, the overall hardness and weight of the core can be adjusted to optimum values by properly adjusting the amounts of the crosslinking agent and filler (e.g., zinc oxide and barium sulfate) blended.

The core-forming composition obtained by blending the above-mentioned components is generally milled in a conventional mixer such as a Banbury mixer and roll mill, compression or injection molded in a core mold, and then heat cured under the above-mentioned temperature condition, whereby a solid core having an optimum hardness distribution is obtainable.

The intermediate layer 3 enclosing the core 2 is formed to a hardness higher than the core surface hardness. Preferably, the intermediate layer hardness is higher than the core surface hardness by 2 to 15 degrees, more preferably 5 to 10 degrees. The intermediate layer hardness is not particularly limited insofar as it is higher than the core surface hardness although it is preferred that the intermediate layer have a hardness of 65 to 85 degrees, especially 68 to 80 degrees on JIS-C hardness scale. With an intermediate layer hardness below 65 degrees, the ball as a whole would be too soft to provide restitution whereas an intermediate layer with a hardness of more than 85 degrees is too hard and would adversely affect feeling.

The gage, specific gravity and other parameters of the intermediate layer can be properly adjusted insofar as the objects of the invention are attainable. Preferably the gage is 0.2 to 2.5 mm, especially 0.5 to 2.3 mm and the specific gravity is 0.9 to 1.3, especially 0.95 to 1.2.

Since the intermediate layer 3 serves to compensate for a loss of restitution of the solid core which is formed soft, it is formed of a material having high resilience insofar as a hardness within the above-defined range is achievable. Use is preferably made of thermoplastic resins including ionomer resins, for example, Himilan 1601 and 1557 (manufactured by Mitsui-duPont Polychemical K. K.), Surlyn 8120 (E. I. dupont), and Hytrel 4767 (Toray-duPont K. K.). An inorganic filler such as zinc oxide and barium sulfate as a weight controlling agent and an additive such as titanium dioxide for coloring may be added to the thermoplastic resin including ionomer resins.

The cover 4 enclosing the intermediate layer 3 must have a higher hardness than the intermediate layer since it should prevent a lightweight ball from lofting by controlling the spin rate thereof. Preferably, the cover is formed to a hardness higher than the intermediate layer hardness by 2 to 15 degrees, especially by 5 to 10 degrees. A hardness difference of 2 degrees or less would be insufficient to control the spin rate, allowing the ball to rise sharply. A hardness difference of more than 15 degrees would require a too hard cover which leads to poor hitting feel. The cover hardness is not particularly limited insofar as it is higher than the intermediate layer hardness. Preferably the cover is formed to a hardness of 75 to 90 degrees, more preferably 75 to 85 degrees on JIS-S scale. If the cover has a hardness of less than 75 degrees, it is too soft to provide restitution and would allow the ball to gain an increased spin rate and rise sharply, resulting in a reduced flight distance. On the other hand, a cover having a hardness of more than 90 degrees would be too hard, leading to poor feel and durability.

The gage, specific gravity and other parameters of the cover may be properly adjusted insofar as the objects of the invention are attainable. Preferably the gage is 0.2 to 2.5 mm, especially 0.5 to 2.3 mm and the specific gravity is 0.9 to 1.2, especially 0.95 to 1.15. The gage of the intermediate layer and cover combined is preferably at least 2 mm, especially 2.2 to 4.2 mm.

The material of which the cover is formed is not particularly limited. The cover may be formed of any of well-known stock materials having appropriate properties as golf ball cover stocks. For example, ionomer resins, polyester elastomers, and polyamide elastomers may be used alone or in admixture with urethane resins and ethylenevinyl acetate copolymers. Ionomer resins are especially preferred while a mixture of two or more ionomer resins may be used. UV absorbers, antioxidants and dispersing aids such as metal soaps may be added to the cover stock if necessary. The method of applying the cover is not particularly limited and the cover is generally formed over the core by surrounding the core by a pair of preformed hemispherical cups followed by heat compression molding or by injection molding the cover stock over the core.

The thus obtained golf ball of the invention may be formed with dimples in the cover surface in a conventional manner. The ball as molded may be subject to finishing steps including buffing, painting and stamping.

While the three-piece solid golf ball of the invention is constructed as mentioned above, it should have an overall diameter of not less than 42.67 mm in accordance with the Rules of Golf.

The golf ball of the present invention exhibits excellent performance when not only medium and high head speed players, but also low head speed players use it. By the term "low head speed" is meant a head speed of 35 m/sec. or less when a driver (#W1) is used as a club. The golf ball of the invention has very little head speed dependency in that it provides a satisfactory flight distance and feel even for such low head speed players, specifically those players with a head speed around 35 m/sec.

There has been described a golf ball which ensures satisfactory performance independent of head speeds by optimizing the hardness distributions of the core and the ball and setting the ball weight in a relatively light range. Upon full shots with a driver or long iron by a low head speed player, the ball exhibits outstandingly improved flight performance and feeling. Despite such improvements, the performance upon impact at medium to high head speeds is maintained satisfactory. Regardless of their head speed, many golfers may favorably use the ball.

EXAMPLE

Examples of the invention are given below together with Comparative Examples by way of illustration and not by way of limitation.

Examples 1–4 and Comparative Examples 1–2

Solid cores were prepared by milling a rubber composition of the formulation shown in Table 1 and molding and vulcanizing it. The compositions of Examples 1 to 4 and Comparative Example 1 were vulcanized at 160° C. for 20 minutes whereas the composition of Comparative Example 2 was vulcanized at 120° C. for 80 minutes. The cores were measured for JIS-C scale hardness and specific gravity, with the results shown in Table 2. The JIS-C hardness of the core was measured by cutting the core into halves and measuring the hardness at the center (center hardness) and the hardness at core surface or spherical surface (surface hardness). The result is an average of five measurements.

Next, compositions for the intermediate layer and the cover as shown in Table 1 were milled and injection molded over the solid core and the intermediate layer, respectively, obtaining three-piece solid golf balls as shown in Table 2. Whenever the intermediate layer and the cover were molded, the intermediate layer and the cover were measured for JIS-C hardness. The results are also shown in Table 2. The amounts of components blended in the core, intermediate layer, and cover as reported in Table 1 are all parts by weight.

TABLE 1

| | | E1 | E2 | E3 | E4 | CE1 | CE2 |
|---|---|---|---|---|---|---|---|
| Solid Core | Cis-1,4- | 100 | 100 | 100 | 100 | 100 | 100 |

TABLE 1-continued

| | | E1 | E2 | E3 | E4 | CE1 | CE2 |
|---|---|---|---|---|---|---|---|
| | polybutadiene | | | | | | |
| | Zinc acrylate | 23 | 21 | 30 | 22 | 28 | 23 |
| | Zinc oxide | 12.5 | 13.0 | 10.0 | 13.0 | 24.0 | 12.5 |
| | Dicumyl peroxide | 1.0 | 1.0 | 1.0 | 1.0 | 1.0 | 1.0 |
| | *1 | 0.3 | 0.3 | 0.3 | 0.3 | 0.3 | 0.3 |
| Intermediate | Hytrel 4767*2 | — | 100 | — | — | — | 100 |
| Layer | Himilan 1557*3 | 60 | — | 50 | 60 | 60 | — |
| | Surlyn 8120*4 | 40 | — | — | 40 | 40 | — |
| | Himilan 1601*3 | — | — | 50 | — | — | — |
| Cover | Himilan 1557*3 | 50 | — | 50 | 50 | 50 | 50 |
| | Himilan 1601*3 | 50 | — | — | 50 | — | — |
| | Himilan 1605*3 | — | 50 | 50 | — | 50 | 50 |
| | Himilan 1706*3 | — | 50 | — | — | — | — |

*1: 1,1-bis(t-butylperoxy)-3,3,5-trimethylcyclohexane (trade name Perhexa 3M-40 manufactured by Nippon Oil and Fats K. K.)
*2: Polyester type thermoplastic elastomer manufactured by Toray-duPont K. K.
*3: Ionomer resin manufactured by Mitsui-duPont Polychemical K. K.
*4: Ionomer resin manufactured by E. I. duPont of USA The thus obtained golf balls were evaluated for flight performance and hitting feel by the following tests. The results are also shown in Table 2.

Flight performance

Using a hitting machine manufactured by True Temper Co., the ball was actually hit with a driver (#W1) at a head speed of 40 m/sec. (HS40) and 35 m/sec. (HS35) to measure a spin, carry, total distance, and angle.

Hitting Feel

Five golfers with a head speed of 40 m/sec. (HS40) and five golfers with a head speed of 35 m/sec. (HS35) actually hit the balls. The ball was rated according to the following criterion.

O: soft

Δ: ordinary

X: hard

TABLE 2

| | | E1 | E2 | E3 | E4 | CE1 | CE2 |
|---|---|---|---|---|---|---|---|
| Core | Specific Gravity | 1.07 | 1.03 | 1.10 | 1.05 | 1.16 | 1.07 |
| | Surface hardness B (JIS-C) | 73 | 67 | 78 | 70 | 74 | 73 |
| | Center hardness A (JIS-C) | 60 | 51 | 68 | 55 | 65 | 70 |
| | Hardness difference B-A (JIS-C) | 13 | 16 | 10 | 15 | 9 | 3 |
| Intermediate layer hardness (JIS-C) | | 75 | 68 | 80 | 75 | 75 | 68 |
| Cover hardness (JIS-C) | | 80 | 87 | 82 | 80 | 82 | 82 |
| Ball weight (g) | | 43.2 | 42.0 | 44.0 | 42.5 | 45.4 | 43.0 |
| #W1/HS40 | Spin (rpm) | 2500 | 2350 | 2650 | 2410 | 2620 | 2490 |
| | Carry (m) | 182.2 | 183.1 | 184.0 | 182.9 | 179.1 | 180.1 |
| | Total (m) | 192.5 | 194.0 | 195.2 | 192.8 | 190.2 | 190.4 |
| | Angle (°) | 12.6 | 12.7 | 12.5 | 12.6 | 12.4 | 12.6 |
| | Hitting Feel | ○ | ○ | ○ | ○ | Δ | X |
| #W1/HS35 | Spin (rpm) | 3530 | 3300 | 3660 | 3420 | 3640 | 3510 |
| | Carry (m) | 142.5 | 143.8 | 142.3 | 143.0 | 140.0 | 140.9 |
| | Total (m) | 153.0 | 154.2 | 153.0 | 153.6 | 149.8 | 151.1 |
| | Angle (°) | 12.5 | 12.8 | 12.4 | 12.7 | 12.3 | 12.6 |
| | Hitting Feel | ○ | ○ | ○ | ○ | X | X |

As is evident from Table 2, the ball of Comparative Example 1 follows a low trajectory and travels a less flight distance since it is heavy. The ball of Comparative Example 2 is insufficient in flight distance and hitting feel since the hardness distribution of the core is not optimized as shown by a small hardness difference between core surface and core center of 3 degrees.

In contrast, the golf balls of Examples 1 to 4 within the scope of the invention were acknowledged to travel a longer flight distance and offer a pleasant hitting feel upon full shots with a driver at either a head speed of 40 m/sec. or 35 m/sec.

Japanese Patent Application No. 104308/1996 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A three-piece solid golf ball of the three-layer structure comprising a solid core, an intermediate layer, and a cover, wherein the solid core, intermediate layer, and cover each have a hardness as measured by a JIS-C scale hardness meter wherein the core surface hardness is higher than the core center hardness by at least 8 degrees, the intermediate layer hardness is higher than the core surface hardness, the cover hardness is higher than the intermediate layer hardness, and the ball has a weight of 41 to 44.5 grams.

2. The three-piece solid golf ball of claim 1 wherein the core surface has a hardness of up to 80 degrees on JIS-C scale.

3. The three-piece solid golf ball of claim 1 wherein the cover has a hardness of 75 to 90 degrees on JIS-C scale.

4. The three-piece solid golf ball of claim 1 wherein the intermediate layer is composed mainly of a thermoplastic resin.

5. The three-piece solid golf ball of claim 1 wherein the core is formed of a cis-1,4-polybutadiene base rubber and has a specific gravity of 1.02 to 1.2.

* * * * *